US008640874B2

(12) United States Patent
Shin et al.

(10) Patent No.: US 8,640,874 B2
(45) Date of Patent: Feb. 4, 2014

(54) CONFECTIONERY PACKAGE

(75) Inventors: Daniel H. J. Shin, Gyeonggi-do (KR); Heather L. Fluegel, Chicago, IL (US); Robert J. Peterson, Crystal Lake, IL (US)

(73) Assignee: Wm. Wrigley Jr. Company, Chicago, IL (US)

( * ) Notice: Subject to any disclaimer, the term of this patent is extended or adjusted under 35 U.S.C. 154(b) by 0 days.

(21) Appl. No.: 12/990,277

(22) PCT Filed: Apr. 30, 2009

(86) PCT No.: PCT/US2009/042362

§ 371 (c)(1),
(2), (4) Date: Dec. 7, 2010

(87) PCT Pub. No.: WO2009/135036

PCT Pub. Date: Nov. 5, 2009

(65) Prior Publication Data

US 2011/0100855 A1 May 5, 2011

Related U.S. Application Data

(60) Provisional application No. 61/049,607, filed on May 1, 2008.

(51) Int. Cl.

| | |
|---|---|
| ***B65D 83/04*** | (2006.01) |
| ***B65D 1/36*** | (2006.01) |
| ***B65D 5/38*** | (2006.01) |

(52) U.S. Cl.
USPC ..... 206/539; 206/564; 229/125.125

(58) Field of Classification Search
USPC ..... 206/531–532, 538–539, 564, 756, 765; 229/125.125; 220/23.4, 23.8; 221/25
See application file for complete search history.

(56) References Cited

U.S. PATENT DOCUMENTS

| | | | | | |
|---|---|---|---|---|---|
| 1,984,351 | A | * | 12/1934 | Johnson | 206/531 |
| 2,103,241 | A | * | 12/1937 | Bell | 206/564 |
| 2,217,953 | A | * | 10/1940 | Igou | 206/778 |
| 2,386,416 | A | * | 10/1945 | Wilhelm | 206/531 |
| 3,073,433 | A | | 1/1963 | Tapper | |
| 3,184,054 | A | * | 5/1965 | Kuhlman | 220/23.4 |
| 3,578,237 | A | * | 5/1971 | Weiss | 220/23.8 |
| 3,768,639 | A | * | 10/1973 | Dogliotti | 206/564 |
| 3,814,236 | A | * | 6/1974 | Keilman | 206/564 |
| 4,429,792 | A | * | 2/1984 | Machbitz | 206/531 |

(Continued)

FOREIGN PATENT DOCUMENTS

| | | |
|---|---|---|
| DE | 2923106 | 12/1980 |
| FR | 2375110 A | 7/1978 |

OTHER PUBLICATIONS

International Search Report and Written Opinion regarding PCT/US2009/042362, dated Nov. 2, 2010.

*Primary Examiner* — Bryon Gehman
(74) *Attorney, Agent, or Firm* — Armstrong Teasdale LLP

(57) ABSTRACT

A package for holding a plurality of non-spherical products, each product having at least one product axis, is provided. The package comprises a tray defining a tray plane, a plurality of open pockets protruding from the tray plane, each for containing a single product; and each pocket including an angular orienting pocket wall portion for angularly orienting the product within the pocket, so that a product axis is angularly oriented with respect to the tray plane.

17 Claims, 5 Drawing Sheets

(56) References Cited

U.S. PATENT DOCUMENTS

| | | | | |
|---|---|---|---|---|
| 4,593,819 | A * | 6/1986 | Will | 206/538 |
| 5,110,007 | A * | 5/1992 | Law et al. | 221/25 |
| 5,727,687 | A * | 3/1998 | Renner | 206/532 |
| 2008/0053863 | A1 * | 3/2008 | Glydon et al. | 206/531 |
| 2008/0274327 | A1 | 11/2008 | Dean et al. | |
| 2010/0116693 | A1 * | 5/2010 | Hession | 206/784 |

* cited by examiner

CONFECTIONERY PACKAGE

CROSS-REFERENCE TO RELATED APPLICATIONS

This application is a 35 U.S.C. §371 national stage application of PCT/US2009/042362, filed Apr. 30, 2009, and additionally claims priority to U.S. Provisional Application No. 61/049,607, filed May 1, 2008.

BACKGROUND OF THE INVENTION

The present invention relates to a package. In particular the invention relates to a package, including a tray, which is suitable for holding products in pockets at an angle.

A package for merchandising or display has a footprint. A footprint is the area of one of the surfaces of the package, such as area of the length and width. The footprint may also be the area taken up by the package when the package is laid flat on a merchandising display. A package that can hold a product at an angle can reduce the footprint of the package so that a consumer can have a compact and portable package without significantly increasing the depth of the package.

Additionally, it is desirable to have a package that can hold a product at an angle because the package can fit more products without increasing the footprint of the package or without significantly increasing the footprint so that the package may remain portable and pocket-friendly to consumers. Containing more products in a package having a defined footprint is significant especially if product packages are displayed for consumer choice in a rack or holder, which has fixed dimensions. Also, there is a marketing advantage to present an attractive or labeled surface with space for brand names, graphics and text on the package to the consumer rather than lining up packages in a vertical packaging orientation on a rack or holder. From a merchandising standpoint, an advantage is that a package for holding products at an angle provides a consumer with a higher count of product in the package without taking additional space on a merchandising display. From a manufacturing standpoint, an advantage is that a package for retaining products at an angle is filled faster than a package for retaining products in a vertical position.

SUMMARY OF THE INVENTION

In various aspects, a package with a tray and a plurality of pockets on the tray is provided. The pockets are especially suited for holding a product at an angle. The package takes advantage of the product orientation so that a higher count of products can be put in a package without increasing the footprint of the package or without significantly increasing the footprint of the package. Also, the package takes advantage of the product orientation so that the same count of products can be put in a smaller footprint.

In one aspect, a package for holding a plurality of non-spherical products, each product having at least one product axis, includes a tray. The package comprises a tray defining a tray plane, a plurality of open pockets protruding from the tray plane, each for containing a single product; and each pocket including an angular orienting pocket wall portion for angularly orienting the product within the pocket, so that a product axis is angularly oriented with respect to the tray plane.

In another aspect, a package for holding a plurality of products (either cylindrical and/or non-cylindrical products) includes a tray. The package comprises a tray with a plurality of pockets, each pocket including an opening and the opening defining a plane, wherein each pocket can house a product, and a cover removably sealed over each pocket opening. In one aspect, a pocket can house a non-cylindrical product, wherein the product has a first longest dimension and a second longest dimension, so that the second longest dimension of the non-cylindrical product is greater than 0 degrees and less than 90 degrees to the plane of the pocket opening. In another aspect, a pocket can also house a cylindrical product, wherein the product has a length, so that the length of the cylindrical product is greater than 0 degrees and less than 90 degrees to the plane of the pocket opening.

DESCRIPTION OF THE INVENTION

Conveniently, many products are sold to consumers in packages, which contain a plurality of products. Examples of such products include chewing gum and confections. Retailers may display packaged products in a display rack or holder which contain multiple packages for convenient consumer choice and purchase. Typically, such rack or holder has a defined dimension which limits the size of package which such rack or holder may retain. Additionally, product packages are sized to be portable and more conveniently fit in a consumer's pocket or purse.

The present invention provides a package 10 for holding a plurality of products at an angle. The package may hold any product type including pharmaceutical or food products. The food product may include, but not limited to, hard candies, gummy candies, tablets, chewing gum, beads, liquid filled beads, chewy candy, chocolate, caramels, and gumballs. The package may contain pieces of product in a variety of colors, flavors, textures, and other properties. Although preferably one product is retained in a single pocket, multiple products may be placed in a single pocket such that each product is placed at an angle to the tray plane.

Figure 1:
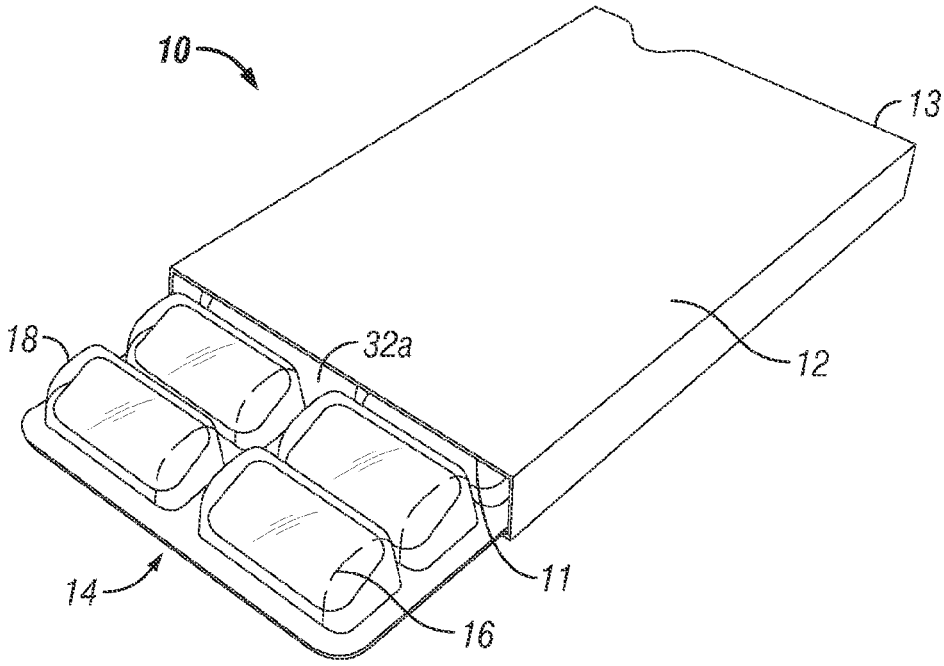
FIG. 1 is a perspective view of an embodiment of a package.

FIG. 1 shows the package 10 including a tray 14 and a sleeve 12 surrounding the tray 14. The tray has open pockets 18 which hold product 16 at an angle in each pocket 18. The sleeve 12 includes at least one open end 11 to allow the tray to be slidably accessed. The second end 13 opposite to the first end 11 may be open, or may include a wall (not shown) to prevent the tray 14 from moving out of the second end 13. In another embodiment, the package 10 includes only the tray 14 and not a sleeve surrounding the tray 14.

Figure 2:
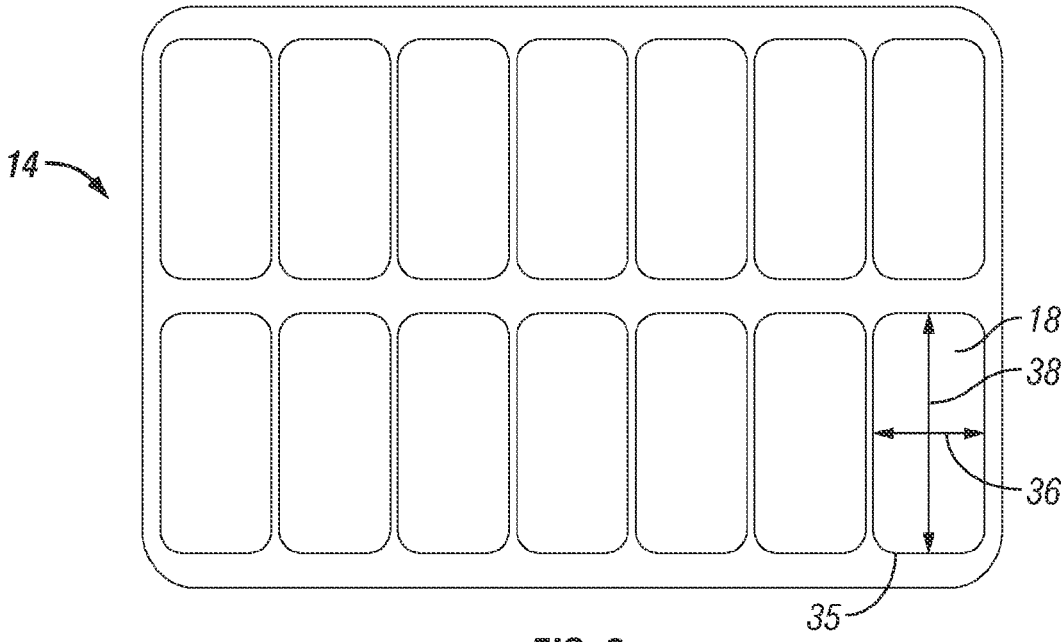
FIG. 2 is a top view of a tray embodiment.
Figure 6:
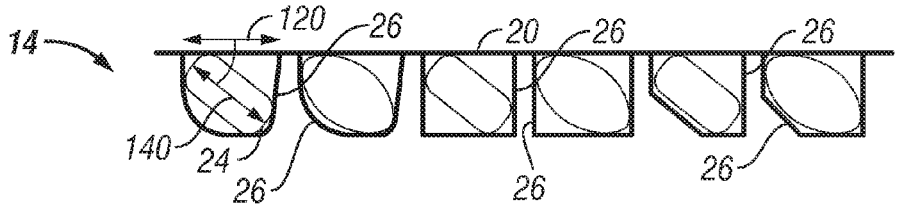
FIG. 6 is a side view of another tray embodiment with product.

The package 10 of this invention has a tray 14 having a surface in which a plurality of pockets 18 forms spaces for individual units of a product. Typically, the tray 14 has a fixed length and width with a relatively thin depth through which the pockets 18 are formed. The tray 14 has a plurality of open pockets 18, as shown in FIG. 2. The pockets 18 define a closed space except for an opening 35 at the surface of the tray 14. Each pocket 18 has an opening 35 and the opening has a length 38 and a width 36. The pocket opening 35 may also define a plane 120 and the plane of the pocket opening 120 for each pocket 18 may be substantially parallel to each other. A plane of a pocket opening is the plane defined by the periphery of the opening of each pocket. The plane of the pocket opening for each of the pockets on the tray may be substantially parallel. Typically, the pockets 18 define a space with side walls 26 and a bottom surface 21. The bottom surface 21 has substantially similar dimensions to the pocket opening 35 in the tray surface or may be larger or smaller, even to a diminishing bottom surface 21 in which the side walls 26 meet at a defined point or line as shown in FIG. 6. Typically, at least one side wall 26 is substantially vertical with respect to the plane of the tray 110. A tray plane 110 is the plane defined by the substantially flat side of the tray. The side walls 26 may be formed such that opposing sides of the pocket 18 are substantially vertical to the tray plane 110 or angled with respect to the tray plane 110. In an aspect of the invention, a pocket 18 is formed with three substantially vertical side walls 26 and with one opposing side wall 26 positioned at an angle to reflect the angle at which the product 16 is placed in the pocket 18 as shown in FIG. 6. Preferably only the side walls 26 retain product 16 at an angle and no additional retention elements are in the pocket 18 other than the side walls 26 or the angularly orienting pocket wall portion 23.

Each pocket 18 also has a pocket depth 22 that corresponds to the distance from the opening of the pocket to the bottom surface of the pocket 21. A pocket depth is the distance from the opening of the pocket to the bottom surface of the pocket. Each pocket may also have a curved pocket wall portion 24. The curved pocket wall portion 24 may have a radius from 1 to 10 degrees. Additionally, the curved pocket wall portion 24 may have a radius from 2 to 7 degrees. The pockets 18 may have a symmetrical or asymmetrical cross section.

Typically, a product is placed in a pocket 18 such that the product 16 can neither stand vertical or lay horizontal to the tray plane 110. Conveniently, this is accomplished by regulating the size of the pocket 18 with respect to the size of the product 16. Because the product 16 is a non-spherical three dimensional object, the relative sizes of the product 16 and pocket 18 are determined such that the object cannot be positioned horizontal to the tray plane 110. Typically, this means that the longest dimension of the product is less than the bottom surface 21 of the pocket. Because the longest dimension of a three-dimensional object may be a diagonal, the pocket 18 may be large enough to hold a product 16 horizontally if carefully placed in the pocket 18. However, if the product is placed in the pocket at an angle, the side walls will retain the object at an angle. Preferably a top cover 20 to the tray 14 will retain the product 16 in the pocket 18 such that the product 16 cannot substantially shift position within the pocket 18.

Figure 3:
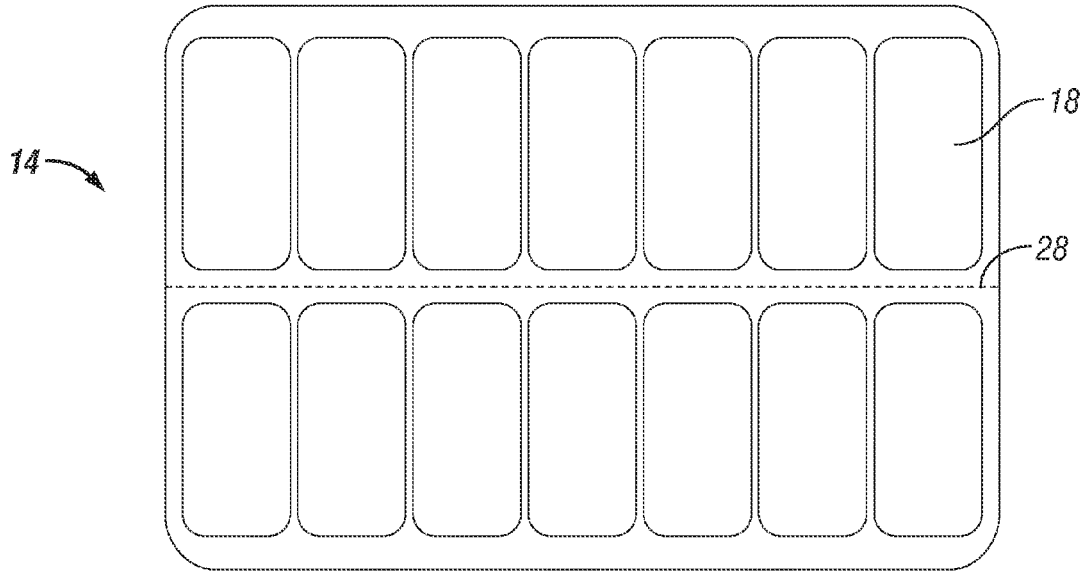
FIG. 3 is a top view of another tray embodiment.
Figure 5:
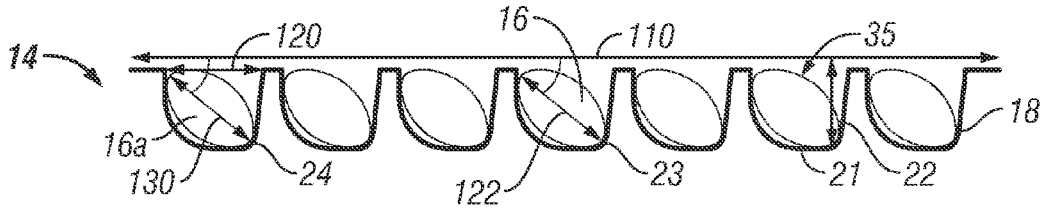
FIG. 5 is a side view of a tray embodiment with product.
Figure 7:
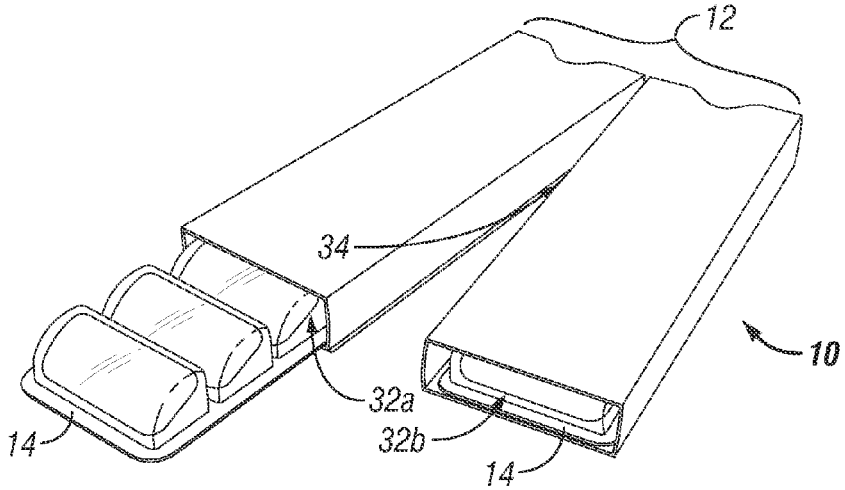
FIG. 7 is a perspective view of another tray and sleeve embodiment in a partial split configuration.
Figure 8:
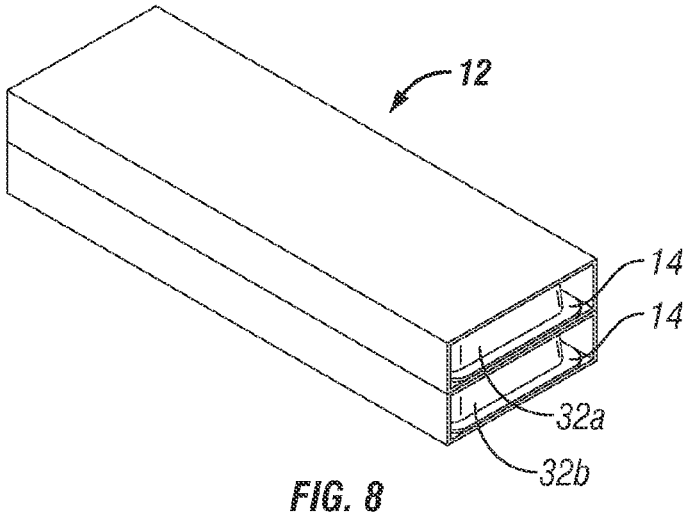
FIGS. 8 to 10 illustrate further embodiments of the package.
Figure 9:
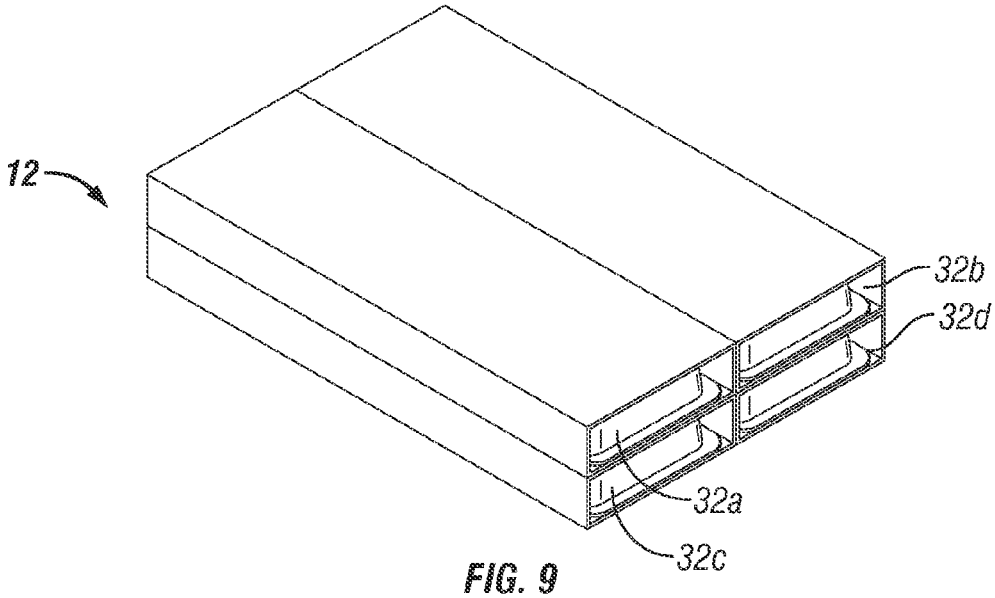
Figure 10:
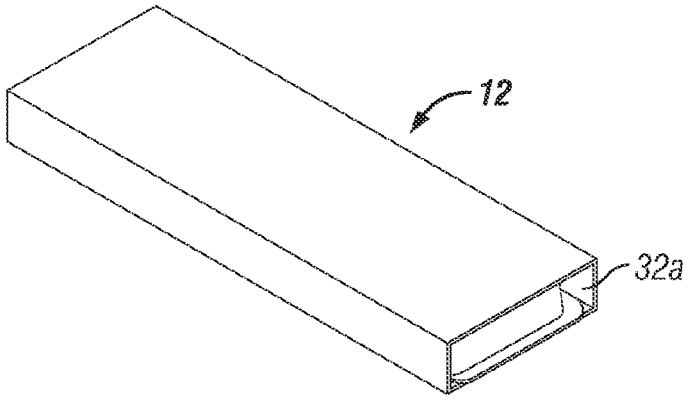

FIGS. 5 and 6 illustrate an asymmetrical and symmetrical cross section of the pockets 18. The tray 14 may comprise open pockets 18 in an array. In one embodiment, there may be just one row of pockets, as shown in FIG. 7. Alternatively, the tray may include two or more rows of pockets. The tray may have at least one perforation to facilitate separation a first part of the tray from a second part of the tray. In one embodiment, as shown in FIG. 3, the tray 14 may have a perforation 28 between rows to allow separation of the rows from each other so that the consumer can carry a more portable package. In another embodiment, each individual pocket may be perforated to allow separation of each pocket from each other.

Figure 4:
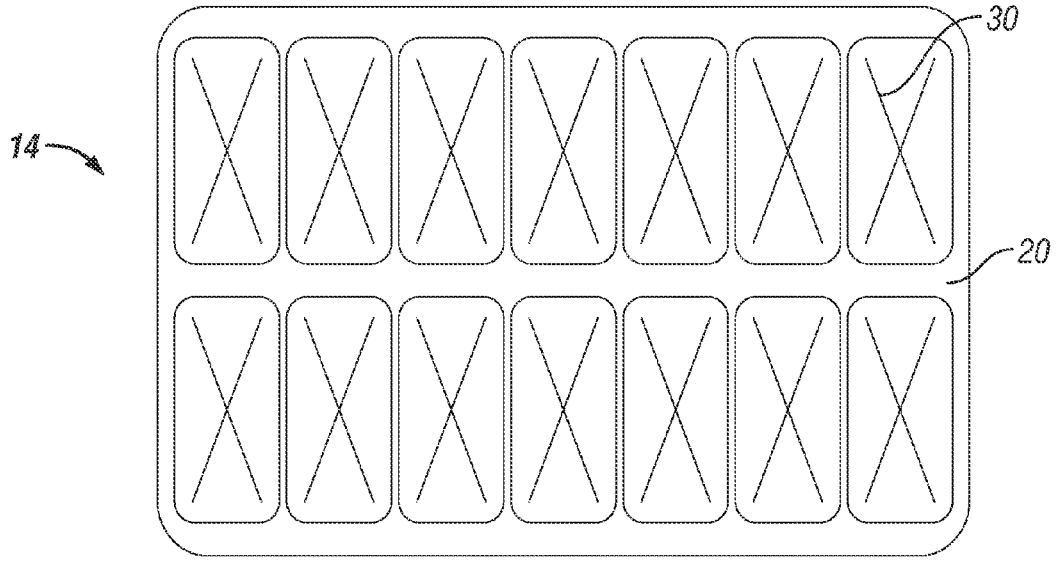
FIG. 4 is a top view of the tray of FIG. 2 with a cover.

FIG. 4 shows a tray 14 with a cover 20. The package of this invention is capable of having a cover 20 placed on the tray 14 to retain product 18. Additionally, a cover 20 may be placed on the tray to close individual pockets 18 to form closed pocket spaces so provide a clean and sanitary product package without the product 18 being exposed to foreign material alike lint, dust, and dirt. A package 10 with closed pocket spaces is preferable for sale to a consumer. The cover 20 may be removably fastened over the open pockets. The cover 20 may be removably fastened to the pockets by heat sealing a rupturable cover, attaching a hinged cover, providing a sliding cover, attaching a resealable film, or other suitable fastening means. In one embodiment, the cover 20 may be removably sealed over each pocket opening for product freshness. In a further embodiment, the cover 20 has a score pattern 30 to facilitate removal of the products from the pockets so that the user can push out the product out of the pocket without using a large force. The score pattern 30 may be created by a laser or mechanical cutting or perforation. The scoring is partially through the cover but does not go through the entire depth of the cover so that a seal is maintained for each pocket for product freshness.

In a typical package 10 of this invention, a plurality of products 16 is placed in the pockets 18 such that products 16 are retained in such pockets 18 at a non-horizontal or non-vertical orientation. In such orientation an axis of the product 122 is inclined with respect to the plane of the tray at an angle more than 0 degrees and less than 90 degrees. Typically, this angle is between 10 and 80 degrees and preferably between 20 and 70 degrees. A more typical angle is 30 to 60 degrees. FIG. 5 shows a tray 14 with a plurality of products 16 in each pocket 18. Each product 16 includes a product axis 122. A product axis 122 is any axis of approximate symmetry through the product 16, such as the center line in a generally cylindrically shaped product, or the axes of symmetry approximately in the direction of the x, y, and z axes where the product is generally rectilinear. A product axis 122 that is angularly oriented with respect to a tray plane 110 is an axis that forms an acute angle between the tray plane and the axis. The tray 14 includes a tray plane 110 and a plurality of open pockets 18 protruding from the tray plane 110. Each pocket 18 has an angular orienting wall portion 23 for angularly orienting a single product 16 within the pocket 18, so that the product axis 122 is angularly oriented with respect to the tray plane 110. For example, the product axis 122 is 35 degrees with respect to the tray plane 110. The embodiment of FIG. 5 may include a cover removably fastened over the pocket openings 35. Additionally the pocket 18 has an opening width 36 that is less than or equal to the length of the product axis 122.

Figure 11A:
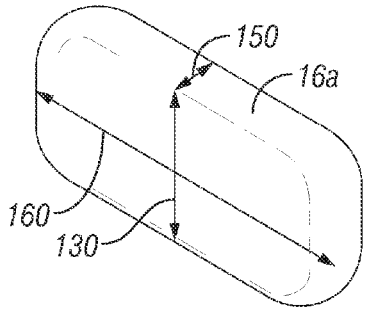
FIGS. 11*a* to 11*f* illustrate different embodiments of product.
Figure 11B:
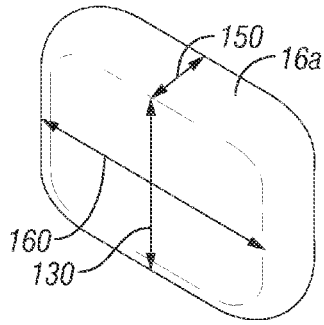
Figure 11C:
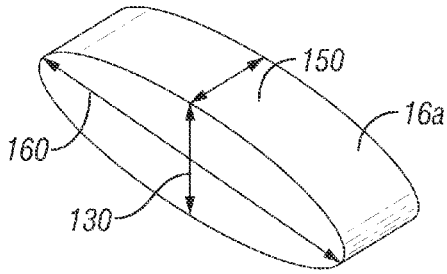
Figure 11D:
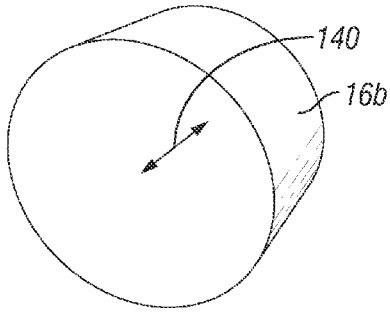
Figure 11E:
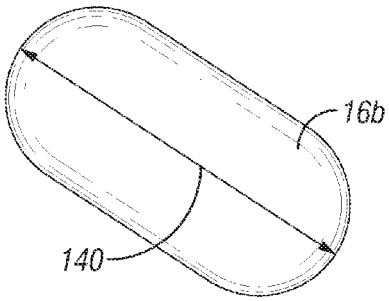
Figure 11F:
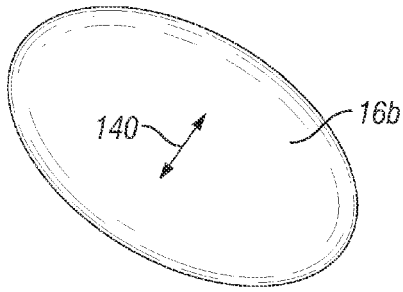

A product useful in this invention is a non-spherical three-dimensional object, with defined length, width and height. An example of such an object is a solid object with a length and cross-section. The cross-section may be rectilinear, polygonal, circular, elliptical, or irregular. The cross-section need not be regular and can be flattened or skewed. In a cylindrical object, the width and depth are identical in all orientations or rotations. FIGS. 11*a* to 11*f* show several different shaped products 16 that can go into the open pockets 18. FIGS. 11*a* to 11*c* are examples of non-cylindrical products 16*a*. A non-cylindrical product includes products that are pillow-shaped, rectilinear, triangular, polygonal, and any combination of same. FIGS. 11*d* to 11*f* are examples of cylindrical products 16*b*. Non-cylindrical products 16*a* like the products of FIGS. 11*a* to 11*c* include at least two dimensions, a first longest dimension 160 and a second longest dimension 130 that lie on one of the axes of symmetry along the x, y, and z axes of the products. Non-cylindrical products 16*a* like the products of FIGS. 11*a* to 11*c* may also include a third longest dimension 150. FIGS. 11*a* and 11*b* are generally rectilinear products. A cylindrical product includes a solid where a substantial part of the cross section is circular in which the centers of the circles substantially lie in a single line. A length of a cylinder is the length of the line formed by the centers of the circles. Cylindrical products include pill shaped, disk shaped, donut shaped, cigarette shaped, and combination of same. Cylindrical products 16*b* like the products of FIGS. 11*d* to 11*f* include a cylinder length 140. FIG. 11*d* is an example of a disk shaped product. FIG. 11*e* is an example of a pill shaped or capsule shaped product. FIG. 11*f* is an example of a donut shaped or a flattened cylindrical shaped product. Other shapes are also contemplated like rod-shaped products where the product has an elongated volume and is oriented by the length, or irregularly shaped products with at least one dimension that is different than the other two major dimensions of the product.

In one embodiment, the package 10 for containing a plurality of non-cylindrical products 16*a* comprises a tray 14. The non-cylindrical product 16*a* has a first longest dimension 160 and a second longest dimension 130. The tray 14 comprises a plurality of pockets 18 and each pocket 18 includes an opening 35 and the opening defines a plane 120. Each pocket 18 can house a product so that the second longest dimension 130 of the non-cylindrical product is greater than 0 degrees and less than 90 degrees to the plane of the pocket opening 120. Additionally, each pocket 18 can house a product so that the second longest dimension 130 of the non-cylindrical product is greater than 10 degrees and less than 60 degrees to the plane of the pocket opening 120. Each pocket 18 may include a pocket depth 22 that is less than the second longest dimension 130 of the non-cylindrical product. Each pocket 18 may also include a pocket opening width 36 that is less than or equal to the second longest dimension 130 of the non-cylindrical product.

In another embodiment, as shown in FIG. 6, the package 10 for containing a plurality of cylindrical products 16*b* comprises a tray 14. The cylindrical product 16*b* includes a cylinder length 140. The tray 14 comprises a plurality of pockets 18 and each pocket 18 includes an opening 35 and the opening defines a plane 120. Each pocket 18 can house a product so that the length 140 of the cylindrical product is greater than 0 degrees and less than 90 degrees to the plane of the pocket opening 120. Additionally, each pocket 18 can house a product so that the length 140 of the cylindrical product is greater than 10 degrees and less than 60 degrees to the plane of the pocket opening 120.

The package 10 may include a sleeve 12 surrounding the tray 14. The sleeve 12 may have one or more compartments 32*a*, 32*b*, 32*c*, 32*d*. FIGS. 1 and 7 to 10 are examples of different sleeve configurations. The sleeve 12 of FIG. 1 and FIG. 10 has one compartment 32*a*. The sleeve 12 of FIG. 7 has 2 compartments 32*a*, 32*b* that are side by side. The sleeve of FIG. 8 has 2 compartments 32*a*, 32*b* that are on top of each other. The sleeve of FIG. 9 has 4 compartments 32*a*, 32*b*, 32*c*, 32*d* that are side by side and on top of each other. The sleeve compartments are releasably attached to each other by a perforation, adhesive, pressure sensitive label, or combinations thereof.

A method of packaging product is provided. The product that is packaged may be any non-spherically shaped product such as cylindrical, non-cylindrical, rectilinear, and other shapes. First, a tray 14 with a plurality of pockets 18 is provided. Each pocket 18 including an opening 35 and the opening defining a plane 120, wherein each pocket 18 can house a product 16 at an angle that is greater than 0 degrees and less than 90 degrees to the plane of the pocket opening 120. If the product is a non-cylindrical product 16*a* having a longest dimension 160 and a second longest dimension 130, the product 16*a* is oriented so that the second longest dimension 130 of the product 16*a* is greater than 0 degrees and less than 90 degrees to the plane of the pocket opening 120. Alternatively, if the product is a cylindrical product 16*a* having a length 140, the product 16*b* is oriented so that the length 140 of the product is greater than 0 degrees and less than 90 degrees to the plane of the pocket opening 120. Each pocket 18 has a curved pocket wall portion 24 for biasing a product 16 within the pocket 18, so that the second longest dimension of the product 130 or the length 140 of a cylindrical product is greater than 0 degrees and less than 90 degrees to the plane of the pocket opening 120. Typically, the radius of the curved pocket wall portion 24 is 2 to 7 degrees.

Next, the plurality of pockets 18 is filled with a plurality of products 18 and then a cover 20 is removably attached to the tray. The cover 20 may be removably attached by heat sealing. Additionally, the cover 20 may be scored with a laser before being removably attached to the tray or the cover 20 may be scored after being removably attached to the tray. The method further includes orienting the plurality of products 16 in the plurality of pockets 18 by vibrating the tray 14, sweeping the tray 14 with a wipe (not shown), or sweeping the tray 14 with a brush (not shown).

Next, a sleeve 12 is provided and the tray 14 and cover 20 are put into the sleeve 12. The sleeve 12 may be pre-formed before the tray 14 and cover 20 are placed into the sleeve. Alternatively, the sleeve 12 may be formed on-line by wrapping a sleeve blank around the tray 14 and cover 20.

The package may be any size suitable for a given product. Typically, the package has a footprint wherein the length may be from 70 mm to 110 mm and the width may be from 50 mm to 75 mm. The depth of package may be from 7 mm to 15 mm. The package is desirably sized to conveniently fit in a consumer's clothing pocket, purse, or bag.

The package may be made of any suitable material. The tray of the package may be made of a transparent or translucent material so that the contents of the pockets can be seen. The tray may be made from plastic (flexible or rigid), paperboard, metal, or any combination of materials. The sleeve may be made from plastic, paper, paperboard, recycled paperboard, film laminated paperboard, or other suitable materials. The cover may be made of a transparent or translucent material so that contents of the pockets can be seen through the cover. The cover may be made from foil, plastic, plastic film, or any combination of materials.

While the invention has been described with respect to certain preferred embodiments, as will be appreciated by those skilled in the art, it is to be understood that the invention is capable of numerous changes, modification, and rearrangements, and such changes, modifications and rearrangements are intended to be covered by the following claims.

The invention is claimed as follows:

1. A package for containing a plurality of non-spherical confection products, the package comprising:

a) a tray defining a tray plane at one side of the tray;

b) a plurality of open individual pockets protruding from the tray plane, each individual pocket provided for containing a single product, wherein each pocket has a plurality of sidewalls extending from the tray plane forming the individual pockets and defining a receptacle for receiving a product, wherein the sidewalls of each pocket include a substantially vertical sidewall and an opposing curved sidewall that meets the substantially vertical sidewall at a curved continuous angular orienting pocket wall portion for angularly orienting the product within the receptacle of the pocket;

c) a cover removably sealed over the plurality of open individual pockets; and d) a plurality of non-spherical products each having a longest dimension and a second longest dimension, wherein one of the non-spherical products is positioned within each open individual pocket such that the second longest dimension of the one non-spherical product is positioned greater than 0 degrees and less than 90 degrees relative to the tray plane and such that the receptacle of each open individual pocket has a depth less than the second longest dimension of the one non-spherical product.

2. The package of claim 1 wherein the cover is rupturable.

3. The package of claim 1 further comprising a sleeve surrounding the tray.

4. The package of claim 3 wherein the sleeve has two or more compartments and each sleeve compartment houses a tray.

5. The package of claim 4 wherein the sleeve compartments are releasably attached to each other.

6. The package of claim 5 wherein the sleeve compartments are releasably attached to each other by a connection selected from the group consisting of perforation, adhesive, pressure sensitive label, and combinations thereof.

7. The package of claim 3 wherein the sleeve comprises material selected from the group consisting of paperboard, plastic, and combinations thereof.

8. The package of claim 1 wherein each non-spherical product is positioned so that the second longest dimension of the non-spherical product is greater than 10 degrees and less than 60 degrees relative to the tray plane.

9. The package of claim 1 wherein the cover comprises material selected from the group consisting of foil, plastic film, and combinations thereof.

10. The package of claim 1 further comprising a sleeve surrounding the tray.

11. The package of claim 1 wherein the tray having at least one perforation to facilitate separation of a first part of the tray and a second part of the tray.

12. The package of claim 1 wherein the receptacle of each pocket defines a width, the non-spherical product positioned within the pocket such that the width is less than or equal to the second longest dimension of the non-spherical product.

13. The package of claim 1 wherein the cover is made of foil.

14. The package of claim 1 wherein a plane of a pocket opening for each of the pockets is substantially parallel to the planes of the openings of the other pockets.

15. A package comprising:

a) a tray defining a tray plane at one side of the tray;

b) a plurality of pockets formed in the tray plane and each containing a non-spherical product, each of the pockets having an opening in the tray plane and having sidewalls defining a receptacle that receives the non-spherical product, wherein the sidewalls of each pocket extend from the tray plane separating each pocket from other pockets, wherein each pocket has a depth such that the non-spherical product contained in the pocket does not intersect the tray plane;

c) each pocket having a substantially vertical sidewall and an opposing curved sidewall that meets the substantially vertical sidewall at a continuous curved angular orienting pocket wall portion, wherein each of the non-spherical products has a longest dimension and a second longest dimension, wherein one of the non-spherical products is positioned within each pocket such that the second longest dimension of the one non-spherical product is positioned greater than 0 degrees and less than 90 degrees relative to the tray plane and such that the receptacle of each pocket has a depth less than the second longest dimension of the one non-spherical product; and d) a cover removably sealed over each pocket opening.

16. A package containing a plurality of non-spherical products, the package comprising:

a) a tray defining a tray plane;

b) a plurality of pockets formed in the tray plane, each of the pockets having an opening in the tray plane and having sidewalls defining a receptacle to receive at least one product, the sidewalls including a substantially vertical sidewall and an opposing curved sidewall that meets the substantially vertical sidewall at a continuous curved angular orienting pocket wall portion;

c) each pocket containing at least one product having a longest dimension and a second longest dimension, wherein each individual product is positioned within its respective pocket such that the second longest dimension of the individual product is positioned greater than 0 degrees and less than 90 degrees relative to the tray plane and such that the receptacle of each pocket has a depth less than the second longest dimension of the individual product;

d) a cover sealed to the pocket openings in the tray to retain the products; and e) a sleeve surrounding the tray, wherein the sleeve has two or more compartments and each sleeve compartment houses a tray, and wherein the sleeve compartments are releasably attached to each other.

17. A package comprising:

a) a plurality of products, each product having a longest dimension and a second longest dimension;

b) a tray comprising a plurality of open pockets protruding from a tray plane, each pocket containing one of the products, wherein each pocket includes a substantially vertical sidewall and an opposing curved sidewall that meets the substantially vertical sidewall at a curved continuous angular orienting pocket wall portion, and wherein the one product is positioned within the pocket such that the second longest dimension of the product is positioned greater than 0 degrees and less than 90 degrees relative to the tray plane and such that each pocket has a depth less than the second longest dimension of the product;

c) each pocket including a pocket opening width that is less than or equal to the second longest dimension of the product;

d) a cover sealed to the open pockets; and e) a sleeve surrounding the tray, wherein the sleeve has two or more compartments and each sleeve compartment houses a tray, and wherein the sleeve compartments are releasably attached to each other.

* * * * *